US009689064B2

(12) United States Patent
Barkey

(10) Patent No.: US 9,689,064 B2
(45) Date of Patent: Jun. 27, 2017

(54) TREATMENT OF ANODIZED ALUMINUM COMPONENTS

(71) Applicant: Dale P. Barkey, Lee, NH (US)

(72) Inventor: Dale P. Barkey, Lee, NH (US)

(73) Assignee: The University of New Hampshire, Durham, NH (US)

( * ) Notice: Subject to any disclaimer, the term of this patent is extended or adjusted under 35 U.S.C. 154(b) by 249 days.

(21) Appl. No.: 13/929,318

(22) Filed: Jun. 27, 2013

(65) Prior Publication Data

US 2014/0004269 A1 Jan. 2, 2014

Related U.S. Application Data

(60) Provisional application No. 61/666,418, filed on Jun. 29, 2012.

(51) Int. Cl.
*C23C 10/18* (2006.01)
*C23C 10/24* (2006.01)

(52) U.S. Cl.
CPC ..... *C23C 10/24* (2013.01); *C23C 10/18* (2013.01)

(58) Field of Classification Search
None
See application file for complete search history.

(56) References Cited

U.S. PATENT DOCUMENTS

| | | | | |
|---|---|---|---|---|
| 2,454,227 | A | 11/1948 | Smith et al. | |
| 2,474,440 | A | 6/1949 | Smith et al. | |
| 4,202,706 | A | 5/1980 | Newell et al. | |
| 5,411,607 | A * | 5/1995 | Basaly et al. | 148/272 |
| 5,891,269 | A * | 4/1999 | Koerner et al. | 148/272 |
| 2002/0033208 | A1 | 3/2002 | Krishnaswamy, Jr. | |
| 2008/0274375 | A1 | 11/2008 | Ng et al. | |
| 2009/0263724 | A1 * | 10/2009 | Guyomard et al. | 429/305 |
| 2011/0284381 | A1 * | 11/2011 | Cabot et al. | 205/50 |
| 2012/0088033 | A1 | 4/2012 | Sheehy | |
| 2013/0011688 | A1 * | 1/2013 | Beaver | 428/469 |

FOREIGN PATENT DOCUMENTS

| | | |
|---|---|---|
| WO | 2011146020 | 11/2011 |
| WO | 2011146397 | 11/2011 |

OTHER PUBLICATIONS

Levy, "A New Infrared Technique for Characterizing Partially Amorphous Solids," Journal of Catalysis 8 (1967), 87-90.
Levy, "The Effect of Foreign Ions on the Stability of Activated Alumina," Journal of Catalysis 9 (1967), 75-86.
Runge, "Microcrystalline Anodic Aluminum Oxide Coatings: A Revolutionary Basis Technology for Corrosion Protection," Sanford Process Corporation (2011).
International Search Report and Written Opinion issued in International Patent Application No. PCT/US2013/048260 dated Dec. 6, 2013 (10 pages).

* cited by examiner

*Primary Examiner* — David Turocy
(74) *Attorney, Agent, or Firm* — Grossman, Tucker, Perreault & Pfleger, PLLC

(57) ABSTRACT

The present disclosure relates to a method of incorporating lithium into a coating. One may supply a substrate having a coating containing aluminum ions and immersing the substrate including the coating containing aluminum ions in a water-soluble diketone including lithium for exchange where the ketone carbonyls are separated by at least one carbon atom. This may then be followed by exchanging a portion of the aluminum ions with lithium ions from the diketone solution. Such coatings may have improved chemical resistance.

8 Claims, 2 Drawing Sheets

TREATMENT OF ANODIZED ALUMINUM COMPONENTS

CROSS-REFERENCE TO RELATED APPLICATIONS

This application claims the benefit of U.S. Provisional Application No. 61/666,418 filed Jun. 29, 2012.

FIELD OF INVENTION

The present disclosure relates to a process for exchanging available aluminum ions in an alumina coating with lithium ions and, in particular, a method of treating an anodized aluminum component, wherein lithium is incorporated into the alumina coating of the component which provides a gain in chemical resistance.

BACKGROUND

Aluminum anodizing is an electrochemical process technology which imparts an abrasion and corrosion resistant oxide coating to aluminum and its alloys. Oxide layers formed at high current are relatively hard and are generally referred to as hard coat. Low-temperature hard anodizing produces a black coating that is desirable for many applications, including non-stick cookware. Hard coat is also used in many applications calling for abrasion and corrosion resistance, including vehicle and machine parts, laptop cases, surgical cases and structural materials.

In addition, anodized aluminum may be dyed and sealed or further treated. For example, the MICRALOX process available from Katandin may be used on surgical cases. This process is understood to include a dying step, nickel acetate seal and a final proprietary step that imparts high chemical resistance. The treated coating appears to contain metallic nickel particles produced in the nickel acetate seal. However, these coatings may not be suitable for cookware as they contain dye and nickel.

Aluminum is an amphoteric metal, meaning that the metal and its oxides dissolve much more rapidly in high and low pH solutions than in neutral solutions. Cleaning solutions like those used in dish washers and autoclaves are alkaline, high pH liquids. Accordingly, there remains room for improved anodized coatings that can survive relatively high pH treatments, relatively low pH treatments and combinations thereof over many cycles.

SUMMARY

The present disclosure relates to a method of treating a substrate including an alumina coating, wherein the alumina coating includes aluminum ions that may be exchanged with lithium ions. The method includes immersing the substrate including the alumina coating in a water-soluble diketone including lithium for exchange where the ketone carbonyls are separated by at least one carbon atom, such as a methylene group, which water-soluble diketone may be represented by the formula:

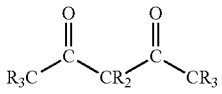

In the above formula, R may be a hydrogen or an alkyl group, with the requirement that the diketone remain water soluble and include an affinity for forming the indicated lithium compound. That is, upon exposure to lithium, the following reaction may proceed:

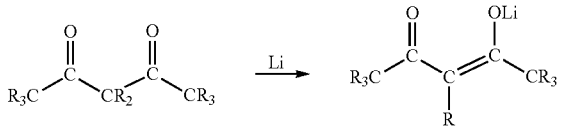

An exemplary diketone is therefore a lithium acetylacetonate solution wherein the lithium acetylacetonate is represented by the following chemical formula:

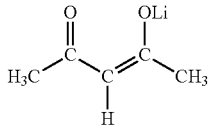

The aluminum anodized surface may then be treated with the lithium acetylacetonate solution followed by exchanging a portion of the aluminum ions with lithium ions from the lithium acetylacetonate solution. Lithium may therefore be incorporated into the alumina coating to influence coating properties. These coatings contain lithium indicated improved chemical resistance relative to the untreated aluminum anodized substrates.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
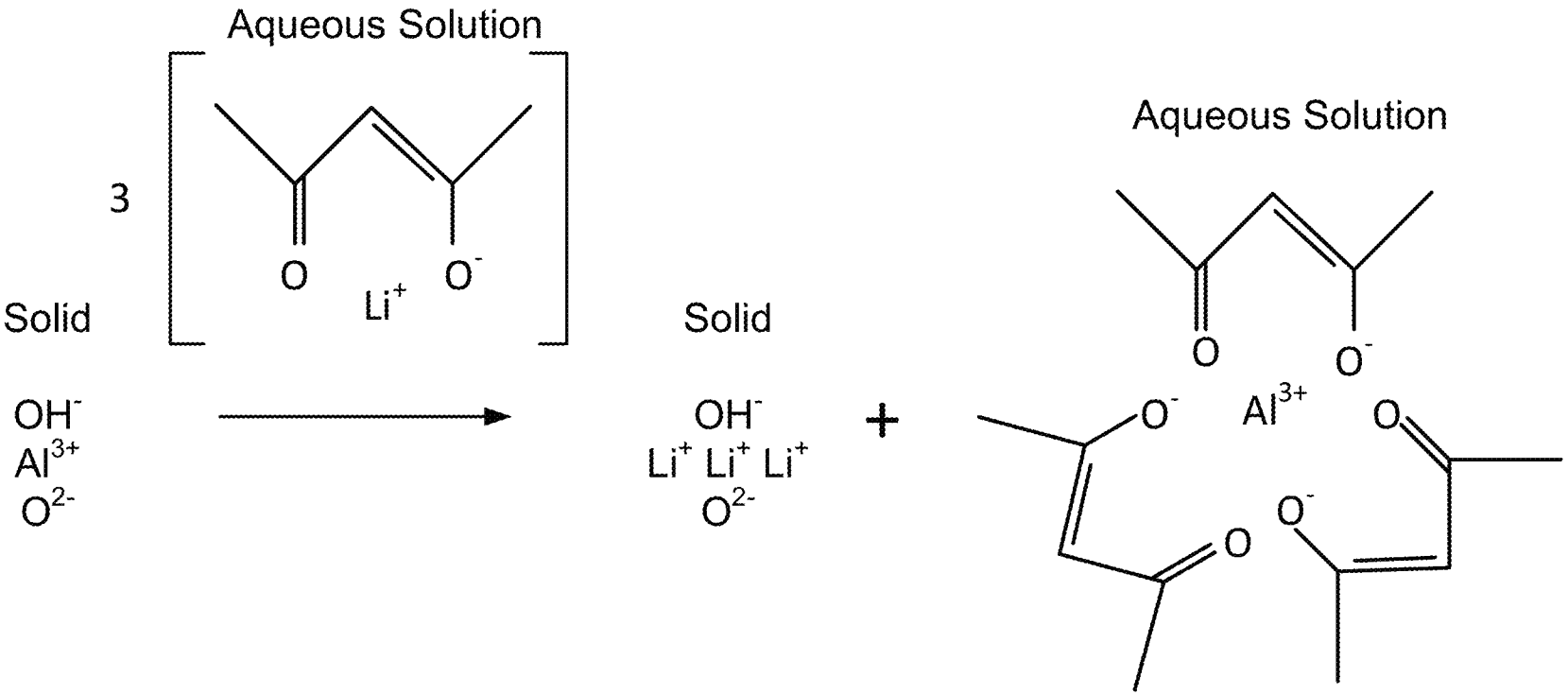
FIG. 1 illustrates a proposed reaction mechanism for exchanging a fraction of aluminum in alumina coatings with lithium on an anodized aluminum substrate, retaining the physical properties of the alumina while improving the chemical resistance.

The present disclosure relates to a process for exchanging available aluminum with lithium in an alumina coating and, in particular, a method of treating an anodized aluminum component, wherein lithium is incorporated into the anodized aluminum to improve chemical resistance.

As noted above, aluminum anodizing is an electrochemical process that imparts an abrasion and corrosion resistant oxide coating to aluminum and its alloys. In a typical operation, an aluminum part is immersed in sulfuric acid solution and subjected to an anodic current. Oxidation of the metal produces a layer of aluminum oxide several tens of microns thick on the surface. The layer is porous, with nanometer-sized pores extending almost all the way to the metal surface. In subsequent wet-chemical treatment, these pores are often sealed, in some cases after a dye has been deposited in them. Oxide layers formed at high current are very hard and are referred to as hard coat. Low-temperature hard anodizing produces a black coating that is desirable for many applications. Ambient temperature hard coat anodizing, including low-voltage anodizing in which the applied current contains both DC and AC components, is colorless and may be dyed by screen printing. Such ambient temperature processes may include the Sanford Quantum Process available from Katandin. Black hard coat is the basis for non-stick cookware. Hard coat is also used for surgical equipment cases and in many applications calling for abrasion and corrosion resistance, including vehicle and machine parts, laptop cases and structural or architectural components.

Anodizing may be performed in a line of process tanks. Parts to be anodized are conveyed overhead from one tank to another. The parts are first passed through cleaning and rinsing tanks, then placed in the anodizing tank. Post-anodize treatments may include dye and seal steps. In a typical sealing process, the anodized part is immersed first in a dye and then in a hot solution of nickel acetate. The aluminum oxide is converted to a hydrated form with a relatively higher specific volume, resulting in closure of the pores. This imparts a degree of corrosion resistance, although it does little to improve chemical resistance.

However, aluminum is an amphoteric material, meaning that the metal and its oxides dissolve much more rapidly in high and low pH solutions than in neutral solutions. Alumina, the material that makes up the coatings formed in anodizing, can assume several microstructures at room temperature and the chemical resistance of the material varies among these forms. As-formed anodic coatings are understood to be non-crystalline, i.e., amorphous, and exhibit relatively low chemical resistance. Alumina that contains a few percent alkali metal ions tends to form Boehmite, a more chemically resistant crystalline form.

To address the relatively low chemical resistance the anodized components may now be treated to exchange available aluminum in the alumina coating with lithium wherein lithium is incorporated into the alumina coating of the component, wherein the lithium catalyzes a conversion to a crystalline form of alumina. Thus, the anodized aluminum parts, as produced by the above process, may be conveniently immersed in a solution of lithium and a water soluble diketone including lithium for exchange where the ketone carbonyls are separated by at least one carbon atom, such as a methylene group, which water soluble diketone may be represented by the following formula:

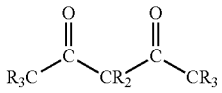

In the above formula, R may be a hydrogen or an alkyl group, such as a methyl, ethyl, ethylene and/or propylene group with the requirement that the diketone remain water soluble and include an affinity for forming the indicated lithium compound. The water solubility is preferably at least 50 g/liter. However, water solubility may preferably be in the range of 50 g/liter-150 g/liter. That is, upon exposure to lithium, the following reaction may proceed:

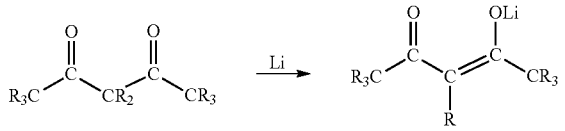

A preferred diketone is therefore a lithium acetylacetonate solution wherein the lithium acetylacetonate is represented by the following chemical formula:

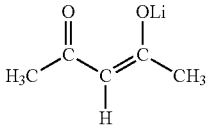

Acetylacetonate, also known as 2,4-pentanedionate, plays the role of binding aluminum ions relatively strongly, so that it tends to exchange the lithium for aluminum. The process is believed to induce crystallization to the more stable γAlOOH (boehmite) FCC form, which generally contains one to two percent alkali metal ions in place of aluminum ions. It is also contemplated that the relatively small lithium ion is more readily inserted into the alumina structure.

FIG. 1 illustrates the substitution process of the aluminum ions in the anodized coating (alumina) with the lithium ions from the preferred lithium acetylacetonate solution. It is contemplated that the process exchanges one aluminum ion for every three lithium ions to maintain neutral media.

The underlying aluminum substrates may include an aluminum alloy. One example includes AL6061 which generally includes 0.6 at % Si, 0.28 at % Cu, 0.7 at % Mn, 0.8 at % Mg, balance Al, wherein at % is atomic percent. AL6061 is generally understood as being a relatively strong and machinable alloy that is in common use. It is also contemplated that aluminum alloys from one or more of the following series may be utilized: series 2,000 aluminum alloys that include at least at least 2.0 atomic percent copper; series 3,000 aluminum alloys that include at least 1.0 atomic percent magnesium; series 6,000 aluminum alloys (other than AL6061 discussed above) that include both manganese present at 0.5 atomic percent or greater and silicon present at 0.4 atomic percent or greater; and series 7,000 aluminum alloys that include at least 1.0 atomic percent zinc. It understood that cookware may be fabricated with series 3000 alloys because these alloys are relatively easily formed. Series 2000 and 7000 alloys may be used in many relatively demanding applications such as aircraft and weaponry. While series 3000 alloys may be relatively easily subject to hard coat, 2000 and 7000 series alloys may be relatively more challenging.

Thus, the present application is directed to a method of treating an anodized aluminum substrate. The substrate may be anodized using low temperature processes or ambient temperature processes. For example when using low temperature, direct current (DC) hard-coat anodizing conditions, the reaction vessel may be immersed in an ice bath to maintain a temperature near zero degrees, typical of industrial hard-coat processing. Then current may be applied at density of the following process profile: 60 s at 15 mA/cm$^2$, 60 s at 25 mA/cm$^2$, 60 s at 35 mA/cm$^2$ and 2220 s at 35 mA/cm$^2$. The substrates may then be rinsed in deionized water and dried.

After anodization, the substrate including an alumina coating ($Al_2O_3$) may then be treated with the lithium acetylacetonate. Specifically, the anodized substrate may be immersed in a 0.1 to 1.0 M solution of lithium acetylacetonate, including all values and ranges therein. The solution may be at an elevated temperature, in the range of 25° C. to 100° C., including all values and ranges therein. Furthermore, the specimens may be immersed for 5-60 minutes, including all values and ranges therein.

The present application is also directed to a method of exchanging available aluminum with lithium in an alumina coating, wherein the substrate including the alumina coating ($Al_2O_3$) may be treated with a diketone containing lithium, such as lithium acetylacetonate. Specifically, the alumina coated substrate may be an anodized aluminum component immersed in a 0.1 to 1.0 M solution of lithium acetylacetonate, including all values and ranges therein. The solution may be at an elevated temperature, in the range of 25° C. to 100° C., including all values and ranges therein. Furthermore, the specimens may be immersed for a period of time in the range of 5 min to 60 min, including all values and ranges therein.

These methods may be used as a one-step post-anodize treatment to impart chemical resistance to hard coat. It is contemplated that the treatment components may be used in food and medical applications. In particular, it is envisioned that this coating may be used for non-stick cookware, which may be converted to a chemically resistant form by immersion in lithium acetylacetonate solution.

In addition to the above, the application is also directed to a two-step post-anodize process in which the anodized part is treated with a nickel-acetate seal prior to the preferred use of lithium acetylacetonate to exchange aluminum ions for lithium. Accordingly, the above methods may include the additional step of treating the substrate with nickel acetate. Specifically, the substrate may be immersed in a 0.1 M to 0.6 M, including all values and increments therein, solution of nickel acetate at temperatures in the range of 40° C. to 100° C., including all values and ranges therein for a period of time in the range of 5 min to 30 min, including all values and increments therein, which may then be followed by immersion in a solution of lithium acetylacetone as described above. Areas of opportunity for this sealed coating may include parts for vehicles, tools, machinery or weaponry.

The rate of attack by alkaline solution on the alumina coatings including partial substitution of lithium in exchange for available aluminum described herein is reduced by a factor of at least ten by this treatment when compared with coatings without the treatment. The treatment is suitable for other applications that require resistance to alkaline solution. The treatment may also improve resistance to mild acid environments such as may be produced by handling or by contact with ambient organic matter.

EXAMPLES

A number of aluminum specimens, 3.5 mm diameter AL6061 rod, were masked with PTFE shrink-wrap tubing leaving one centimeter in length exposed. The rods were anodized using low temperature, direct current (DC) hard-coat anodizing conditions. Specifically, the reaction vessel was immersed in an ice bath to maintain a temperature near zero degrees, typical of industrial hard-coat processing. The applied current density followed the program: 60 s at 15 mA/cm$^2$, 60 s at 25 mA/cm$^2$, 60 s at 35 mA/cm$^2$ and 2220 s at 35 mA/cm$^2$. The samples were then rinsed in deionized water and dried.

The anodized specimens, including an alumina coating, were then treated by immersion in lithium acetylacetonate solution, at the boiling temperature to promote the diffusion of lithium into the alumina. The conditions used are outlined in Table 1 below. After treatment, the samples were rinsed and dried.

The corrosion resistance of the treated anodized specimens was then tested. An additional layer of shrink-wrap was applied that overlapped the first layer by about one millimeter to avoid edge effects in the resistance test. The rods, including untreated controls, were then immersed in one molar potassium hydroxide solution at room temperature and observed for a period of up to one hour. The coatings dissolve and the solution directly contacts the underlying metal resulting in a reaction of the solution and aluminum to produce hydrogen gas. The times were recorded at which the first hydrogen bubble appeared, the coating was covered with a blanket of bubbles and the bubbles streamed vigorously off the surface. As can be seen in the Table below, treatment with lithium acetate reduced the rate of attack by a factor of more than 10.

TABLE 1

Treatment Conditions and Testing Results

| Trial No. | Solution | Temp | Treatment Time/min | First Bubbles/min | Blanketed/min | Streaming/min |
|---|---|---|---|---|---|---|
| 1 | 1.0 M Lithium Acetylacetonate | Boil | 60 | 15 | 30 | Not observed |
| 2 | 1.0 M Nickel Acetate then 1.0 M Lithium Acetylacetonate | Boil | 30/30 | 15 | 20 | 20 |
| 3 | Untreated | | | 1 | 3 | 6 |

Figure 2:
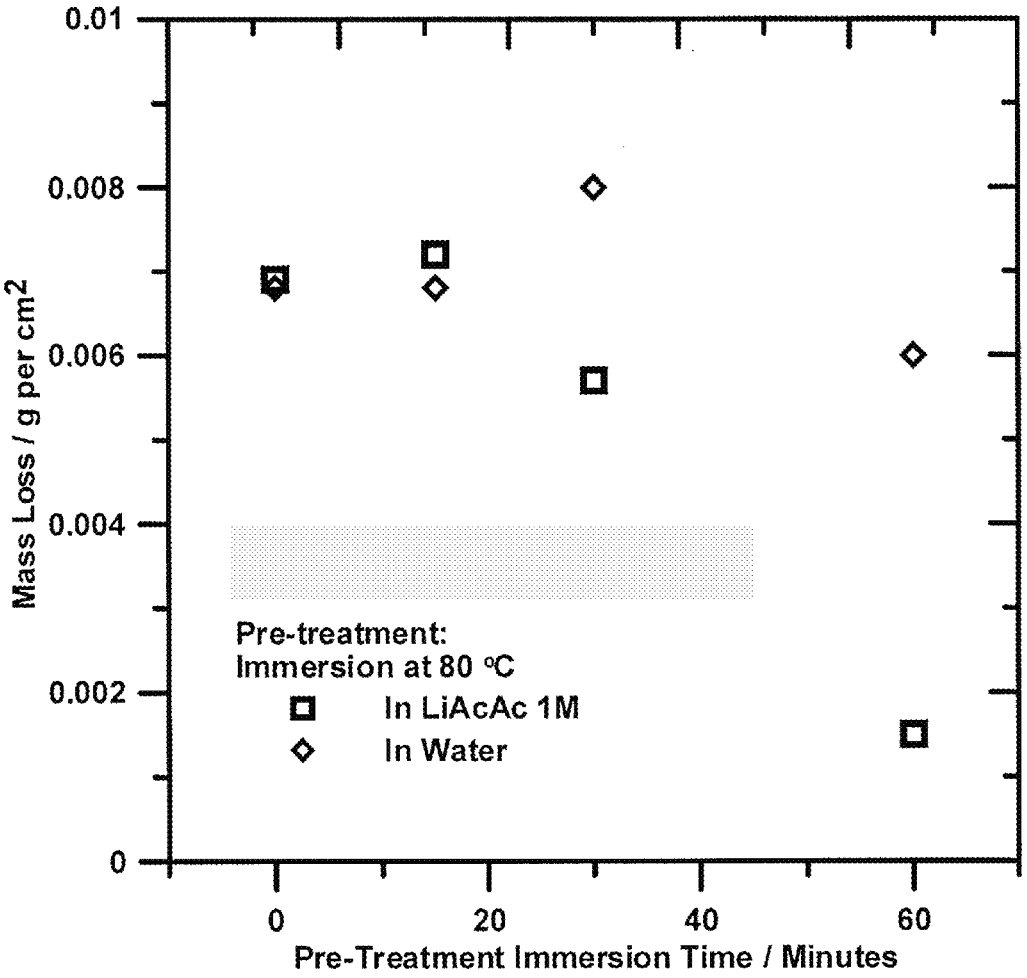
FIG. 2 is a plot of mass loss (g/cm$^2$) after 5 minutes in 1M KOH versus pretreatment immersion time for an aluminum substrate treated with 1M lithium acetylacetonate versus pretreatment with only water. The mass loss reported for each data point is after 5 minutes in KOH.

In addition, reference is made to FIG. 2, which shows the mass loss in grams per square centimeter of an aluminum substrate after 5 minutes in 1M KOH versus pretreatment immersion times for: (1) a pretreatment with lithium acetylacetonate (LiAcAc) solution (1M) at 80° C. at the indicated times; (2) pretreatment with only water. As can be seen, with pretreatment of the aluminum substrate with lithium acetylacetonate solution for 30 and 60 minutes, there is a significant drop in the mass loss as compared to pretreatment of the aluminum substrate with only water.

What is claimed is:

1. A method of incorporating lithium into a coating:

supplying a substrate having an alumina coating containing aluminum ions;

immersing said substrate including said alumina coating containing aluminum ions in a solution containing a water-soluble diketone including lithium for exchange where the ketone carbonyls are separated by at least one carbon atom and includes lithium acetylacetonate having the following structure

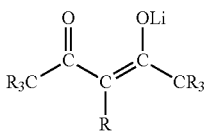

where R may be a hydrogen or an alkyl group; and exchanging one to two percent of said aluminum ions in said alumina coating with lithium ions from said diketone solution and incorporating lithium into said alumina coating.

2. The method of claim 1, wherein said substrate having said alumina coating aluminum ions comprises an anodized aluminum substrate.

3. The method of claim 1, wherein said coating comprises one or more of the following elements: silicon, copper, manganese, magnesium and zinc.

4. The method of claim 1, wherein said lithium acetylacetonate is present in said solution at a concentration in the range of 0.1 M to 1.0 M.

5. The method of claim 1, wherein said solution is a buffered solution.

6. The method of claim 1, wherein said substrate is immersed for a period of 5 minutes to 60 minutes, wherein said solution of lithium acetylacetonate is at a temperature in the range of 25° C. to 100° C.

7. The method of claim 1, further comprising immersing said substrate in nickel acetate solution prior to immersing said substrate in said lithium acetylacetonate.

8. The method of claim 7, wherein said nickel acetate solution has a nickel acetate concentration in the range of 0.1 M to 0.6 M.

* * * * *